United States Patent [19]

Schreiner

[11] Patent Number: 4,676,026

[45] Date of Patent: Jun. 30, 1987

[54] WINDOW OR DOOR CONSTRUCTION FOR A BUILDING

[76] Inventor: Johann Schreiner, 67 Tufnell Dr., Winnipeg R2N 1J7 Manitoba, Canada

[21] Appl. No.: 844,843

[22] Filed: Mar. 27, 1986

[30] Foreign Application Priority Data

Apr. 15, 1985 [DE] Fed. Rep. of Germany ..... 3513469

[51] Int. Cl.[4] ..... E06B 3/00

[52] U.S. Cl. ..... 49/501; 49/504; 49/401; 49/484

[58] Field of Search ..... 49/501, 504, 505, 419, 49/420, 401, 484

[56] References Cited

U.S. PATENT DOCUMENTS 3,256,641 6/1966 Johnson ..... 49/419
3,583,114 7/1969 Belfor ..... 49/505 X

FOREIGN PATENT DOCUMENTS 1812212 6/1970 Fed. Rep. of Germany ..... 49/505
2522201 12/1976 Fed. Rep. of Germany .
3200261 7/1983 Fed. Rep. of Germany .

OTHER PUBLICATIONS

Publication: Finstral Vauelemente-Vertrieb Germany—14 Mar. 1984.

*Primary Examiner*—Kenneth Downey
*Attorney, Agent, or Firm*—Brooks Haidt Haffner & Delahunty

[57] ABSTRACT

A window or door construction for a building is shown wherein the frame carrying the glass pane or the window or door wing is not fixedly connected to the building but is "floatingly" disposed in a case. Therefore, if adequate spaces are taken into account, the frame can freely move in the case and expand and contract under thermal influences independently of the building. The invention makes it possible to realize window or door constructions of a plastic profile material which, if necessary, also withstand arctic temperatures without their weld joints cracking.

7 Claims, 2 Drawing Figures

WINDOW OR DOOR CONSTRUCTION FOR A BUILDING

DESCRIPTION

Figure 1:
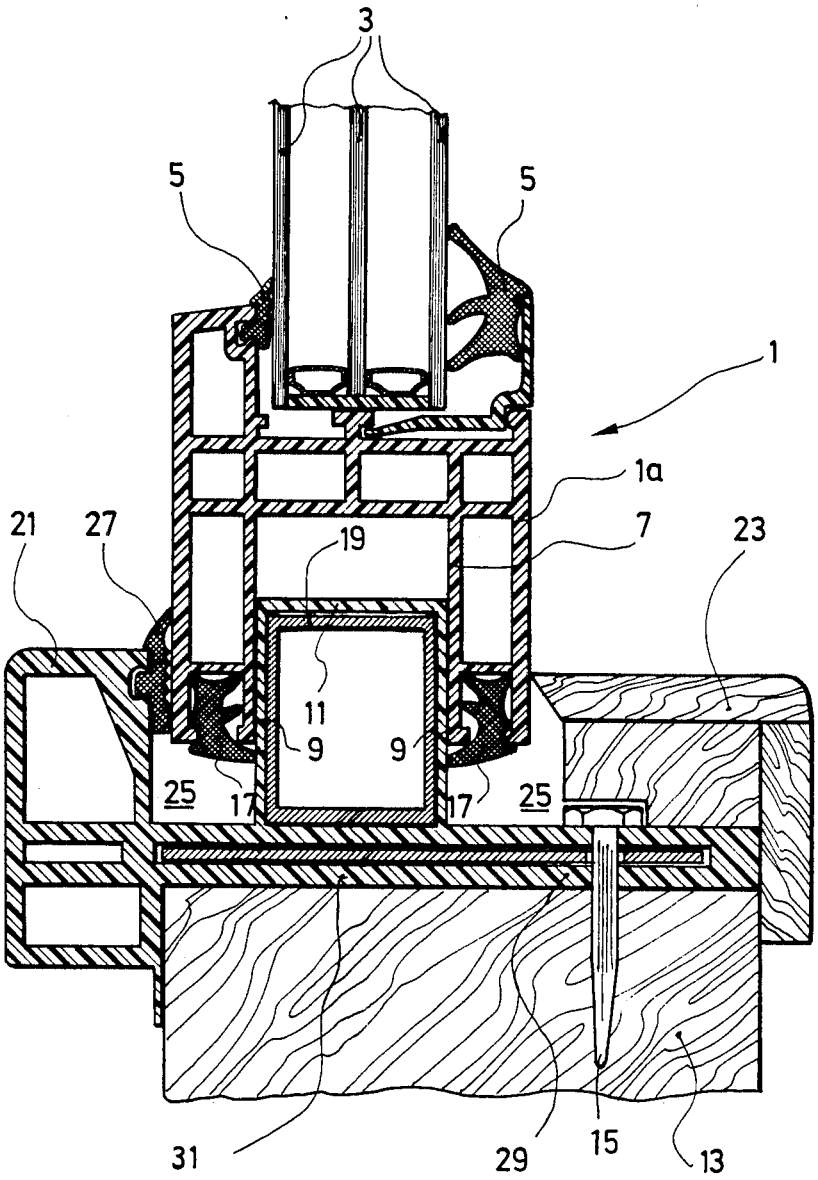

This invention relates to a window or door construction for a building which includes a frame of a plastic profile material for holding a single or multiple glass pane or for holding at least one window or door wing pivotally and/or tiltably mounted thereon.

Window or door constructions of this type are generally known. The frames mentioned consist of individual bars of a plastic profile material which are welded together at their ends provided with miters. These frames are fastened into the window or door opening with the help of screw bolts.

In regions showing extreme differences in climate, window or door constructions of this type have turned out to be of little use, in particular when the profiles are not made of white but colored plastic so that under extreme solar radiation there are great increases in temperature which lead to an excessive expansion of the plastic material and result in distortions which deform the window or the door. On the other hand, as a result of extremely low temperatures, it can be observed that the frames break, in particular that they crack at the weld points. Therefore, even if the frames are used in a temperate climate, for instance in Central Europe, constructions of a white plastic material are almost exclusively found because these constructions do not warm up so much under solar radiation.

It is therefore the object of the present invention to show a window or door construction of the type mentioned at the outset which can also be used in regions with great differences in temperature w1thout showing any tendency to damage and which nevertheless fulfills its sealing function with respect to cold and rain.

The present invention provides a window or door construction for a building wherein the window or door frame is no longer fixedly connected to the building but quasi "floats" in a case so that the frame can move in the case. The case itself may be of a multipart construction and can therefore accommodate the thermal expansion movements of the building, which it is attached to, without transmitting these movements to the window or door frame.

It goes without saying that the scope of movability of the frame in the case must be chosen according to the variations in dimension which depend on the temperatures so that on the one hand the frame has sufficient space in the case when it expands, and that on the other hand the frame does not separate from the case when there is a great decline in temperature. In practice the free spaces in the channel-like recesses which receive the frame in the case and retain it on the case must be predetermined correspondingly in dependence of the frame size and the coefficients of thermal expansion and on the basis of specific installation temperatures. The person skilled in the art can determine the corresponding dimensions with the help of his expert knowledge. In so doing, the use of tables is helpful.

A special advantage of the invention consists in that today's commercial plastic profile materials need not be changed or must only be changed in a negligible manner for the adaptation to the obJect of the present invention, and that the construction in the built-in state does not detract from the general esthetic impression in any way.

The invention is applicable to both fixed windows and movable windows, such as side-hung, pivot-hung, top-hung or bottom-hung windows or doors. In this case, the window or door wing itself is not changed in any way; only the frame which holds the window or door wing is adapted to the object of the present invention.

It is expedient to fix the middle of the lower frame bar in the case by means of a screw so that the movements at the two ends of the frame take place to the same extent and the frame does not separate from the case at one side when there are extremely low temperatures and to avoid that the free space within the channel-like recesses must be made unnecessarily large.

Despite the movability of the construction between frame and case it is impossible that rain water can penetrate through the window or door into the building. The retaining rail which secures the frame to the case in one embodiment of the invention represents an insurmountable barrier to the rain water even if the expediently provided seals are once defective. Likewise, the other embodiment of the invention which provides a channel-like recess in the case for receiving the frame can be also protected against the penetration of rain water when there are defective seals by the case being designed in the form of steps in such a manner that the portion of the case bar which is located at one side of the frame is provided at a higher level than the other one with this higher portion having to be located on the inside in the building during later installation.

Figure 2:
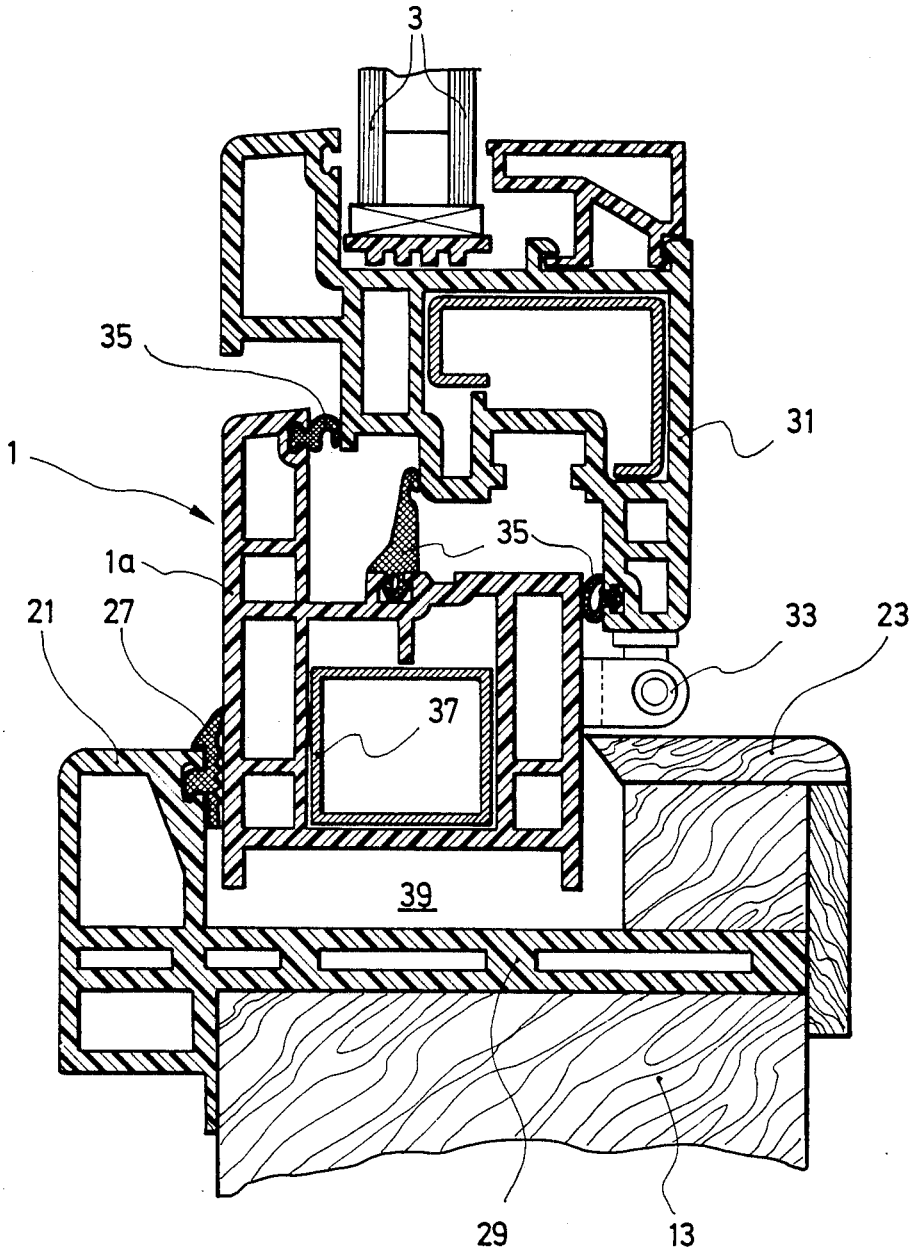

In the following, the invention will be explained in detail with reference to the embodiments shown in the drawings, wherein:

FIG. 1 is a detail of a section through a first embodiment of the invention as illustrated by a fixed window; and FIG. 2 is a second embodiment of the invention as illustrated by a movable window.

FIG. 1 reveals a section of an individual bar 1*a* of a frame 1 of a plastic profile material which carries a threefold glass pane 3 which is sealed by means of elastic lip seal strips 5 and retained on the frame 1.

The frame bar 1*a* has substantially a box-like profile and at its side facing away from the glazing it is provided with a channel-like recess whose opposite walls 9 extend substantially parallel to each other. Hence the frame bar 1*a* has substantially the configuration of an inverted U.

A retaining rail 11 which is of a substantially rectangular cross section and consists of a rigid material, in particular of aluminum, engages the channel-like recess 7 between the walls 9. There is sufficient clearance between the opposite walls of retaining rail 11 and frame bar 1*a* that the frame 1 can move with respect to the rail 11 in the plane defined by the glazing.

As illustrated in the embodiment, the retaining rail 11 is expediently a part of a case 29 to be fastened to the building. A wall portion 13 of the building can be seen in the drawing. Screw bolts 15, as can be seen in FIG. 1, which are screwed through the case 29 into the building wall and subsequently concealed in an expedient manner, as is here shown, are here used for the fastening. In the simplest case, the retaining rail 11 itself can form the case, however, it is preferably a part of the case which covers the reveal, the sill and the lintel of the window or the door at the same time because when there is such a design, the installation on the building can be carried out in a particularly easy and quick manner.

The individual bars of the frame expediently consist of a profile extruded from a plastic material, preferably polyvinyl chloride, and having hollow spaces into which, if necessary, metal reinforcement inserts of steel or aluminum can be put.

In the embodiment illustrated, the retaining rail 11 is hollow and a metal profile rail 19 is inserted into the hollow space. The retaining rail may, however, also consist of two parallel strips with a projection drawn inwards on the respective upper edge, for instance as if in the embodiment shown the greatest part of the cover wall defining the hollow space is missing. In this case, the retain1ng rail can be quasi "buttoned in" from the top between the upright strips of the retaining rail.

Likewise, the portion of the case profile which is adjacent the building wall includes a hollow space into which a reinforcing steel strip 31 is inserted.

The frame on the retaining rail is expediently sealed by means of seal strips. For this purpose, FIG. 1 reveals a respective seal strip 17 on the legs of the bar 1*a* which enclose the retaining rail 11 thereinbetween. These seal strips 17 adjoin the retaining rail 11 with a seal lip on the outside. To improve the sealing effect, lip seals may also be provided on the retaining rail 11 near the inner edge.

Since the frame 1 moves on the retaining rail 11 in the direction of the fastening bolts 15 and different gap widths which are moreover disadvantageous from an optical point of view may develop between the lip seal 17 and the case, it is expedient to cover the edge portion of the frame 1 on the outside and inside with cover strips 21 and 23 which together with the retaining rail form channels 25 which the legs of the bar 1*a* engage. Thus the ends thereof are invisible from the outside. At the same time, these cover strips 21 and 23 can perform a further sealing function; it is particularly expedient to provide the outer cover strip 21 with a lip seal strip 27 which is adjacent the frame bar 1*a* and conslsts of an elastic material. On the inside the cover strip 23 may consist of wood or plastic. It is expedient to combine at least the outer cover strip 21 with the case 29 covering the building parts to form a constructional unit which, if necessary, may additionally incorporate the retaining rail 11 in an integral manner.

FIG.2 shows an alternative embodiment of the invention. Same parts as those which were described with reference to FIG. 1 are provided with identical reference numerals so that a repeated illustration can be dispensed with. The embodiment shows a side-hung window consisting of a window wing 31 which holds a double glazing 3 and is fastened to a frame 1 by means of a hinge 33. The frame 1 and the window wing 31 are provided with elastic lip seals 35 which, as shown, seal the window wing 31 on the frame 1 in the closed state of the window.

In the embodiment shown, the frame 1, which, if necessary, can be reinforced by a reinforcement insert 37, engages a channel-like recess 39 which is formed by the case 29 together with the cover strips 21 and 23. An elastic lip seal strip 27 seals the frame bar 1*a* on the outer cover strip 21.

In both cases it can very clearly be seen from the drawings that the frame 1 and the frame bar 1*a*, respectively, are movably arranged with respect to the case 29 so that the frame quasi "floats" in the case 29. Hence the frame 1 can move independently of the building which is here represented by the reference numeral 13, i.e. it can expand and contract, as already mentioned, the excess dimensions of the case must, however, be chosen adequately large.

For the assembly of the window or door construction, it is advantageous to connect the individual bars of the case to one another by means of angle pieces which are to be arranged in the corners and are designed as plug elements which are to be inserted into the hollow spaces of the case profile material. When there is such a construction, the individual bars of the case can then be cut off from the continuous profile material and connected to one another without first mitering the bars. When the bars are joined, the case of this embodiment can be especially easily installed around the window or door frame.

As can be seen from the drawings, the construction is not particularly bulky. It can also subsequently be installed on existing buildings in a very easy manner.

I claim:

1. A window or door construction for a building, including a frame of a plastic profile material for receiving a single or multiple glass pane or for holding a window or door wing pivotally and/or tiltably mounted thereon, said construction comprising said frame having at its circumferential side a channel-like recess whose opposite walls preferably extend substantially parallel to each other; and said frame being disposed in a case whose inside dimensions are a few centimeters greater than the corresponding external dimensions of said frame; and said case having at the inner side of all of its legs a respective retaining rail which projects inwards and engages said channel-like recess in said frame profile and whose height is matched to the depth of said channel-like recess such that the distance between opposite retaining rails is respectively a few centimeters greater than the distance of the bottoms of two opposite channel-like recesses; said frame profile and the parts in contact therewith being sealed with respect to each other by elastic seals of profiled material, sealing strips which are adjacent said retaining rail being fastened to a free end of the frame profile.

2. The construction according to claim 1, wherein said case has at least towards one side of said retaining rail a cover strip which extends parallel thereto and forms a channel for receiving a leg portion of said frame profile together with said retaining rail.

3. The construction according to claim 2, wherein said cover strip and said case are designed as a constructional unit.

4. The construction according to claim 2 or 3, wherein said retaining rail and said case are designed as a constructional unit.

5. The construction according to claim 1, wherein sealing strips which are adjacent the neighboring walls of said channel-like recess of said frame profile are fastened to the interior end of said retaining rail.

6. The construction according to claim 2, wherein as sealing strip which is adjacent said frame profile is at least fastened to the exterior cover strip.

7. The construction according to claim 2, wherein said retaining rail is provided at a higher level than said cover strip.

* * * * *